US008479427B2

(12) United States Patent
Verheye et al.

(10) Patent No.: US 8,479,427 B2
(45) Date of Patent: Jul. 9, 2013

(54) MULTI-PLANAR IMAGE DISPLAY SYSTEM AND METHOD

(75) Inventors: Ivan Verheye, S. Barrington, IL (US); Fred B. Weiner, Montclair, NJ (US)

(73) Assignee: Pops3d, Inc., Montclair, NJ (US)

( * ) Notice: Subject to any disclaimer, the term of this patent is extended or adjusted under 35 U.S.C. 154(b) by 0 days.

(21) Appl. No.: 13/451,305

(22) Filed: Apr. 19, 2012

(65) Prior Publication Data

US 2012/0272554 A1 Nov. 1, 2012

Related U.S. Application Data

(60) Provisional application No. 61/480,026, filed on Apr. 28, 2011.

(51) Int. Cl.
*G09F 13/00* (2006.01)
*A47G 1/16* (2006.01)

(52) U.S. Cl.
USPC ..... 40/738; 40/577; 40/743; 428/13

(58) Field of Classification Search
USPC ..... 40/650, 606.12, 738, 743
See application file for complete search history.

(56) References Cited

U.S. PATENT DOCUMENTS

| | | | | |
|---|---|---|---|---|
| 2,565,553 | A * | 8/1951 | Foley | 428/12 |
| 2,984,920 | A | 5/1961 | Acosta et al. | |
| 3,137,080 | A | 6/1964 | Zang | |
| 3,237,332 | A * | 3/1966 | Petrey | 40/738 |
| 3,596,391 | A * | 8/1971 | Knight, Jr. | 40/720 |
| 3,829,998 | A | 8/1974 | Flax | |
| 5,207,495 | A | 5/1993 | Ahlstone | |
| 5,418,579 | A | 5/1995 | Jamieson et al. | |
| 5,617,663 | A * | 4/1997 | Miki et al. | 40/738 |
| 6,536,146 | B2 * | 3/2003 | Ericson | 40/453 |
| 6,607,809 | B2 | 8/2003 | Baker-Salmon | |
| 7,117,621 | B2 * | 10/2006 | Chang | 40/738 |
| 2006/0193030 | A1 | 8/2006 | Babas | |
| 2007/0180744 | A1 | 8/2007 | Babas | |

* cited by examiner

*Primary Examiner* — Casandra Davis
(74) *Attorney, Agent, or Firm* — Sprinkle IP Law Group

(57) ABSTRACT

A multi-planar image display system includes an insert having sheets being held in alignment at opposite edges. The sheets have particularly predetermined widths such that when aligned and affixed to each other, the sheets form predetermined curve profiles with equal spacing between the sheets, allowing a sharp, realistic 3D image to be produced from 2D images printed on the sheets. The system may further include a frame to securely hold the insert in tension without requiring additional fasteners. The frame may hold one or more inserts and allow easy insertion and removal of each insert. The frame may accommodate a cover, a board, a light panel, a cap, a casing, and/or other feature(s) to protect or otherwise accompany the 3D image produced by the insert.

18 Claims, 13 Drawing Sheets

MULTI-PLANAR IMAGE DISPLAY SYSTEM AND METHOD

CROSS-REFERENCE TO RELATED APPLICATION(S)

This is a conversion of and claims a benefit of priority under 35 U.S.C. §119(e) from U.S. Provisional Application No. 61/480,026, filed Apr. 28, 2011, entitled "MULTI-PLANAR IMAGE DISPLAY SYSTEM AND METHOD," which is hereby incorporated by reference in its entirety.

TECHNICAL FIELD

This disclosure relates generally to frames designed for displaying three dimensional images. More particularly, embodiments disclosed herein relate to a method and a corresponding apparatus for the display of multi-planar, auto-stereoscopic images.

BACKGROUND OF THE RELATED ART

First postulated in 1912, three-dimensional (3D) imaging is not new. Currently, various 3D display systems—from holographic imaging systems to medical computed tomography (CT) 3D scanners to auto-stereoscopic display monitors—can create a visual representation of an object in three physical dimensions without the help of 3D glasses. Some of the 3D display systems can project a 3D light field within a volume (hence volumetric) via the emission, scattering, or relaying of illumination from regions in a space defined by x, y, z planes.

However, due to factors such as cost, size, reliability, etc., 3D display systems remain accessible virtually entirely to academics, corporations, and the military. Consequently, there is always room for innovations and improvements.

SUMMARY OF THE DISCLOSURE

In multi-planar 3D, the collective image is printed on several plastic layers with each layer exhibiting varying parts of the entire image. When viewed in entirety, the multi-planar effect delivers dramatic, in depth, 3D imagery. Factors such as cost, size, reliability etc. have traditionally rendered access to 3D multi-planar imagery near inaccessible save for in house use by academics, corporations and the military. Embodiments disclosed herein are directed to a multi-planar image display system that, perhaps for the first time, may properly present this form of 3D imagery to the general public.

Embodiments disclosed herein leverage enabling multi-planar imaging solutions to produce images suitable for 3D presentation. In some embodiments, the multi-planar image display system comprises a frame and an insert. In some embodiments, the multi-planar image display system essentially consisting of an insert. The multi-planar image display system may be referred to as a 3D image display unit or simply a display unit.

Within this disclosure, a "frame" refers to a structure specifically designed and configured to receive or otherwise accommodate an insert for easy insertion and extraction. It is contemplated that a frame can have one or multiple components.

The insert disclosed herein is structured to hold a multi-layer 3D image in perfect register, allowing individual sheets, with varying pieces of the entire image, to find their natural and proper form within a mounted structure, without additional structural support. More specifically, the insert can display a multi-layer 3D image in perfect register without the frame. When this insert is assembled, the individual sheets of images naturally bend into the desired shape (whether concave or convex) to display the multi-layer 3D image in perfectly registered form to provide the optimum multi-planar 3D illusion.

In some embodiments, the multi-planar image display system may further comprise a light source. This frame can be adapted or otherwise implemented to accommodate a light source. The light source may be readily inserted into the frame and/or extracted from the frame in a similar manner as the insert. The light source may provide light from various directions: top, bottom, side, or a combination thereof. Lighting may be in any form of illumination, including but not limited to light emitting diode (LED), fluorescent, electroluminescent, incandescent, etc. As an example, the light source may be an LED board and may be placed behind the insert for rear or back lighting.

Embodiments disclosed herein can provide vastly improved image presentation with ease of insertion and extraction. As those skilled in the art can appreciate, the insert alone can provide a practical means of multi-planar 3D presentation for advertising, promotion and retail image sales. Further, in some embodiments, frames can be made available for all multi-planar adaptable forms of display advertising and promotion and can be used in the displaying of images for any picture that uses multi-planar technology to translate a 2D image to a 3D illusion.

These, and other, aspects of the disclosure will be better appreciated and understood when considered in conjunction with the following description and the accompanying drawings. It should be understood, however, that the following description, while indicating various embodiments of the disclosure and numerous specific details thereof, is given by way of illustration and not of limitation. Many substitutions, modifications, additions and/or rearrangements may be made within the scope of the disclosure without departing from the spirit thereof, and the disclosure includes all such substitutions, modifications, additions and/or rearrangements.

BRIEF DESCRIPTION OF THE DRAWINGS

The drawings accompanying and forming part of this specification are included to depict certain aspects of the disclosure. It should be noted that the features illustrated in the drawings are not necessarily drawn to scale. A more complete understanding of the disclosure and the advantages thereof may be acquired by referring to the following description, taken in conjunction with the accompanying drawings in which like reference numbers indicate like features and wherein.

DETAILED DESCRIPTION

The disclosure and various features and advantageous details thereof are explained more fully with reference to the exemplary, and therefore non-limiting, embodiments illustrated in the accompanying drawings and detailed in the following description. Descriptions of known techniques, tools, materials, and equipment may be omitted so as not to unnecessarily obscure the disclosure in detail. It should be understood, however, that the detailed description and the specific examples, while indicating the preferred embodiments, are given by way of illustration only and not by way of limitation. Various substitutions, modifications, additions and/or rearrangements within the spirit and/or scope of the underlying inventive concept will become apparent to those skilled in the art from this disclosure.

Multi-planar 3D imagery is auto-stereoscopic, meaning visible to the unaided eye. No special glasses are required to view the 3D image. Currently, in presenting a multi-planar 3D illusion, conventional frames do not allow for the ease of insertion and extraction of multi-planar images.

Embodiments disclosed herein provide multi-planar image display systems that can properly present a 3D image from a plurality of 2D image layers. In some embodiments, a multi-planar image display system may comprise an insert. In some embodiments, a multi-planar image display system may comprise an insert and a frame.

Figure 1:
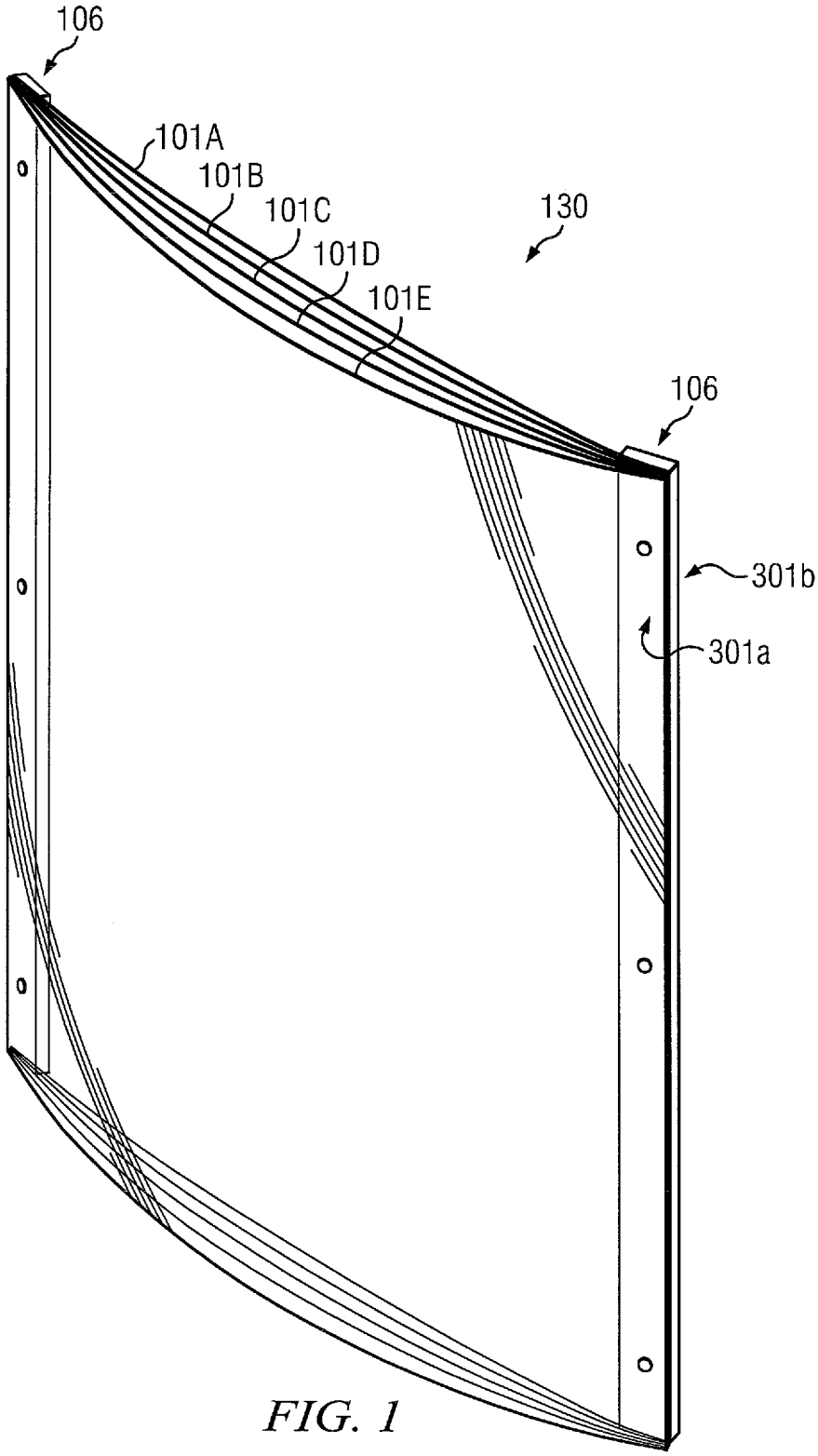
FIG. 1 depicts a diagrammatic representation of a perspective view of an insert disclosed herein.

FIG. 1 depicts a diagrammatic representation of a perspective view of one example embodiment of a multi-planar image display system having insert 130. In this example, insert 130 comprises a set of five sheets 101A-E. Each of these sheets can have a portion of an image printed thereon. These image portions may or may not overlap with each other. If overlapped, some pixels may be found on two or more sheets at the same spot, location, or coordinates with respect to each individual sheet. To achieve a desired effect, a pixel may be printed in full density, half-density or some other density to allow a selected amount of light to pass through each sheet to produce a desired overall color and/or shade.

In the example of FIG. 1, insert 130 is implemented as a standalone unit. In one embodiment, insert 130 may be part of a larger display unit or system. As shown in FIG. 1, all five sheets 101A-E of insert 130 are properly aligned and affixed at opposite edges via a pair of holding means 106. Sheets 101A-E may have different widths and, as depicted in FIG. 1, alignment of their edges may cause sheets 101A-E with varying widths to form a nested set of curve profiles. More specifically, as exemplified in FIG. 1, first sheet 101A may be substantially planar or have a first curvature, second sheet 101B may have a second curvature that is greater than the first curvature of sheet 101A, third sheet 101C may have a third curvature that is greater than the second curvature of sheet 101B, fourth sheet 101D may have a fourth curvature that is greater than the third curvature of sheet 101C, and fifth sheet 101E may have a fifth curvature that is greater than the fourth curvature of sheet 101D.

Embodiments disclosed herein can leverage existing multi-planar methodology to extract and distort cross sectional information from a two-dimensional image source and prepare a series of layered images, each with a different piece of the total image.

To produce the 3D effect properly, the sheets should hold a certain curve and be in alignment. When sheets are aligned, they are said to be in register. Thus, within this document, the term "register" may be used interchangeably with the term "aligned."

Further, the spacing between the sheets needs to be equal in order to create the "depth" perspective for the 3D image. In some embodiments, a curve calculator can take the width, depth and number of layers desired for converting a 2D image to a multi-planar image and calculates the proper spacing between layers, individual layer width, and a distortion factor. A distortion factor may be determined or calculated for each layer, depending on curvature, to attain registration between the layers. The calculation is done to accommodate that information from a flat surface will be displayed on a curved surface. Because these layers have varying sizes in one dimension (whether they have varying lengths or varying widths will depend on the orientation of the final 3D image), when they are aligned at two opposite ends, layers with longer lengths or widths would naturally form curves (convex or concave bends) to allow their ends line up with the layer having the shortest length or width. As described in this disclosure, the varying lengths or varying widths are particularly calculated to cause such curves in order to properly exhibit the image in 3D.

The size of each layer can be critical in producing a proper 3D image. More specifically, the width of each layer (or the height, if the final image is oriented in a landscape mode rather than in a portrait mode) can be very critical to have proper registration of the multiple layers, which create the 3D effect. There is no way to create depth in an image from a single layer. In some embodiments, the number of layers can be as little as 3 and as many as 7 layers or more. To standardize, the default is set to create 5 layers in a 3D image set. A set of five layers will provide excellent contrast for most images. For certain images, seven layers might be even better. In some embodiments, within a set (images belonging to one 3D display) there are 5 film layers having the same height and varying widths.

Several factors may be taken into consideration in constructing an insert for a given frame or display case. First, a holding means is needed to hold multiple sheets in register, while handling them as a set. Second, this holding means should provide a user with the ability to quickly exchange one set of images with another. The sheets need to hold a certain curve in order for the 3D effect to show properly. This means that the spacing between the 5 sheets should be equal in order to create the "depth" perspective for the 3D image.

The multiple layers can be secured in various ways. As discussed above, one way is to secure with riveted end pieces or side panels. The back of the insert can either be clear or solid. A clear back can be useful when a 3D image is mounted into an existing backlit box. A solid back can be useful when the back panel serves as the back cover of a lighted display case. In some embodiments, spacing means can be placed between the back plate and the insert profile to allow for an LED edge-lit panel to be inserted and held in the proper position to provide back lighting.

The different layers making up the total image can be printed on a single sheet, according to one embodiment, or on a set of sheets, according to another embodiment. In some embodiments, the sheet or the set of sheets can be transparent. In some embodiments, the sheet can be non-transparent. In some embodiments, all or some of the set of sheets can be non-transparent. In one embodiment, the set of sheets can be plastic. In one embodiment, the set of sheets can be any suitable material on which the series of layered images can be printed. The layers of images can then be configured, for instance, using creative software techniques, to create the finished volumetric illusion.

In some embodiments, the material used to print the images on can be clear PETG (glycol-modified polyethylene terephthalate). PETG is a co-polyester that is a clear amorphous thermoplastic. PETG sheets have high stiffness, hardness, and toughness as well as good impact strength. Other thermoplastic materials may also be used. In some embodiments, the plastic sheets may have different thicknesses ranging from about 10 mil to about 30 mil. The plastic sheets may include multiple image sizes, for instance, 8"×10", 16"×20", and 24"×30"as well as other image sizes. Those skilled in the art can appreciate that the sheets can be scaled and may be limited only by the capability of the machines used to produce them. One example of a suitable printing machine might be a flatbed inkjet plotter. Depending upon insert volume, various printing devices may be utilized.

In some embodiments, the configured image layers can be distributed, for example, via portable document format (PDF) files, to a commercial printer for printing the images onto the sheet(s). The sheet(s) can then be cut or otherwise trimmed to size to produce the actual image layers in various lengths. In one embodiment, the layers have the same height. In some embodiments, the layers may have different heights. In one embodiment, the layers have the same thickness. In some embodiments, the layers may have different thicknesses.

In some embodiments, at least one hole is punched through each layer. In some embodiments, the at least one hole may be created during the layer trimming process, right before or after each layer is trimmed to size. In one embodiment, the at least one hole may be created simultaneously or substantially simultaneously with trimming each layer to size.

In one embodiment, a computer can be programmed to scan and search for a printing registration on each layer and instruct a cutting machine to trim a particular layer according to a specified dimension. In one embodiment, the computer can be further programmed to punch hole(s) at predetermined position(s) relative to the printing registration.

In one embodiment, each trimmed layer comprises an equal number of holes positioned at opposite ends along the height of the layer. In one embodiment, these holes may be arranged in a symmetrical pattern. In one embodiment, these holes may be arranged in a non-symmetrical pattern. In one embodiment, these holes may be circular in shape. In some embodiments, these holes may be non-circular in shape, including, but are not limited to, squares, rectangles, ovals, stars, etc.

In some embodiments, the trimmed layers are aligned in a specific order at two opposite ends. In one embodiment, the trimmed layers can be aligned utilizing holes created during the layer trimming process. In one embodiment, aligning the trimmed layers comprises placing each hole of a single layer over a pin. For example, five layers, each having three holes on one side, can be aligned by placing the three holes of each layer over three pins. In one embodiment, the pins may be affixed on a jig. In some embodiments, the pins may be secured to a base or any suitable means. In some embodiments, a distance between the pins may be adjustable. In some embodiments, a distance between the pins may be fixed. Other ways to align the trimmed layers are possible and are within the scope of this disclosure.

Because these layers have varying sizes in one dimension (whether they have varying lengths or varying widths will depend on the orientation of the final 3D image), when they are aligned at two opposite ends, layers with longer lengths or widths would naturally form curves (convex or concave bends) to allow their ends line up with the layer having the shortest length or width. As described in this disclosure, the varying lengths or varying widths are particularly calculated to cause such curves in order to properly exhibit the image.

Figure 2:
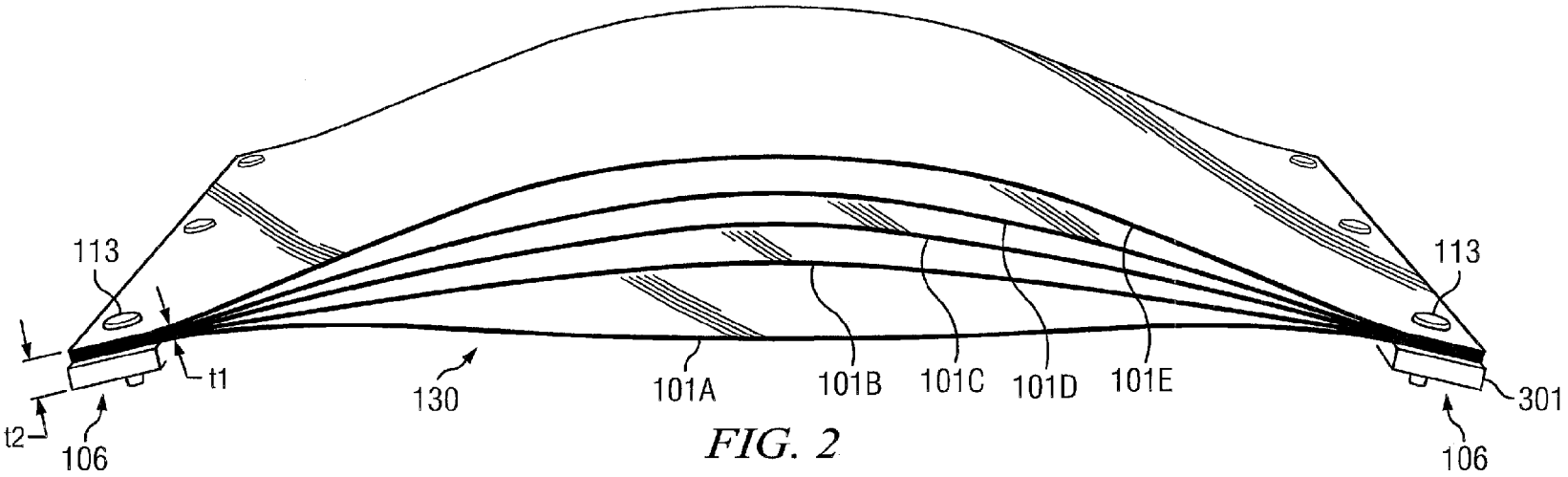
FIG. 2 depicts a top perspective view of one example embodiment of an insert having a plurality of image layers held together at opposite ends via holding means.
Figure 3:
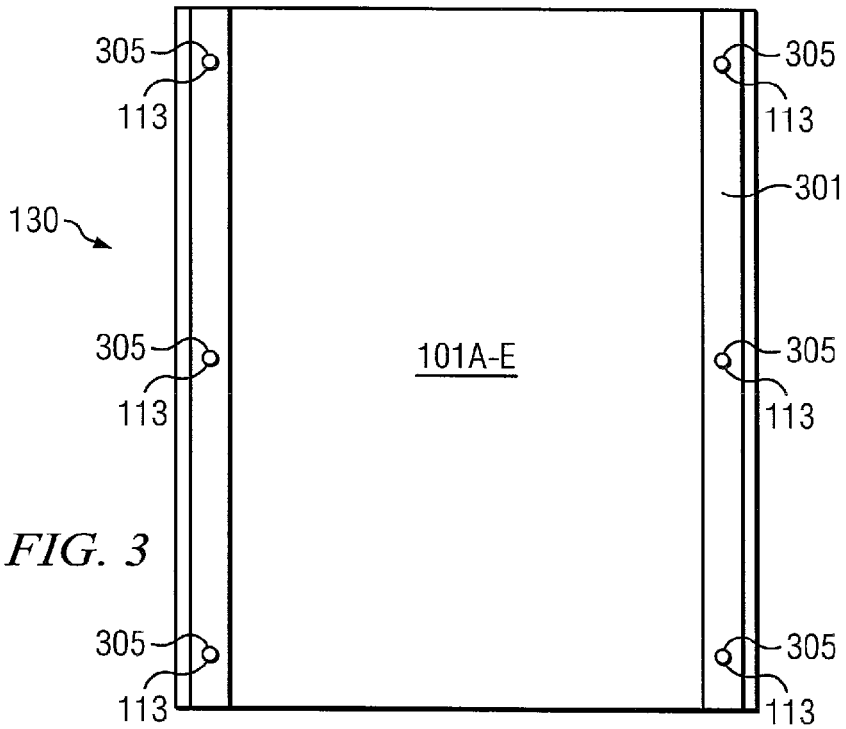
FIG. 3 depicts a diagrammatic representation of a back view of a frame of a multi-planar image display system.

In one embodiment, the trimmed layers can be grouped, stapled, attached, or otherwise affixed to each other at opposite edges of the trimmed layers utilizing suitable holding means. FIG. 2 depicts a top perspective view of one example embodiment of insert 130 having a plurality of image layers 101A-E held together at opposite ends via holding means 106. In this example, holding means 106 comprise fasteners 113 and elongate members, strips, bars, or panels 301. Examples of suitable fasteners 113 may include rivets, set screws, pins, studs, etc. As illustrated in FIG. 3, fasteners 113 may couple sheets 101A-E to panels 301 through corresponding openings or holes 305 located along the length or width thereof at opposite ends, preventing translation or shifting of sheets 101A-E relative to each other.

Referring to FIG. 1, in one embodiment, each panel 301 may comprise members 301*a*, 301*b*. In one embodiment, a method of making an insert may comprise placing a first member of a first panel with pre-drilled holes over a set of pins (not shown), aligning a plurality of sheets over the pins via corresponding holes at a first edge thereof, together or one at a time, and placing a second member of the first panel over the pins. At this point, the pins may be removed. Before or after the removal of the pins, this binding process may be repeated to bind a second panel and the plurality of sheets at a second edge thereof, which is at the opposite end of the first edge. In one embodiment, the plurality of sheets can be aligned and affixed at both edges simultaneously. In some cases, various fasteners and/or adhesives may be applied.

In some embodiments, blind rivets can be used to temporarily line up holes in holding means 106 with holes 305 in sheets 101A-E and bind or otherwise fasten them together to form insert 130. Blind rivets are available in flat head, countersunk head, and modified flush head with standard diameters of 1/8, 5/32, and 3/16 inch. Blind rivets can be made from soft aluminum alloy, steel (including stainless steel), copper, and Monel.

In some embodiments, a 3D image may be produced from three or more sheets. Preferably, a minimum of five sheets is utilized. In some embodiments, the number of sheets included in an insert may depend on a number of factors, including the complexity of the image, the size, a light source, the location of the display system, etc.

In one embodiment, holding means 106 can have holes predrilled to match the size of and distance between the pins. The size, shape, or other feature of openings or holes 305 and/or fasteners 113 may vary from implementation to implementation. For example, holes 305 and fasteners 113 may be configured to allow little or no tolerance once a fastener is inserted into a corresponding hole. In some embodiments, the process of inserting a fastener in a hole may bias sheets 101A-E in alignment.

In one embodiment, holding means 106 can be made of a plastic material, a composite material, a metal, an alloy, or other suitable means. In one embodiment, holding means 106 can be rectangular end pieces. Those skilled in the art will appreciate that holding means 106 can be implemented in various ways. For example, in one embodiment, holding means 106 may have no holes and may be affixed or attached to sheets 101A-E using an adhesive or a mechanical means such as a clip for maintaining proper alignment of sheets 101A-E. Other mounting and binding methods and materials are also possible.

Figure 4:
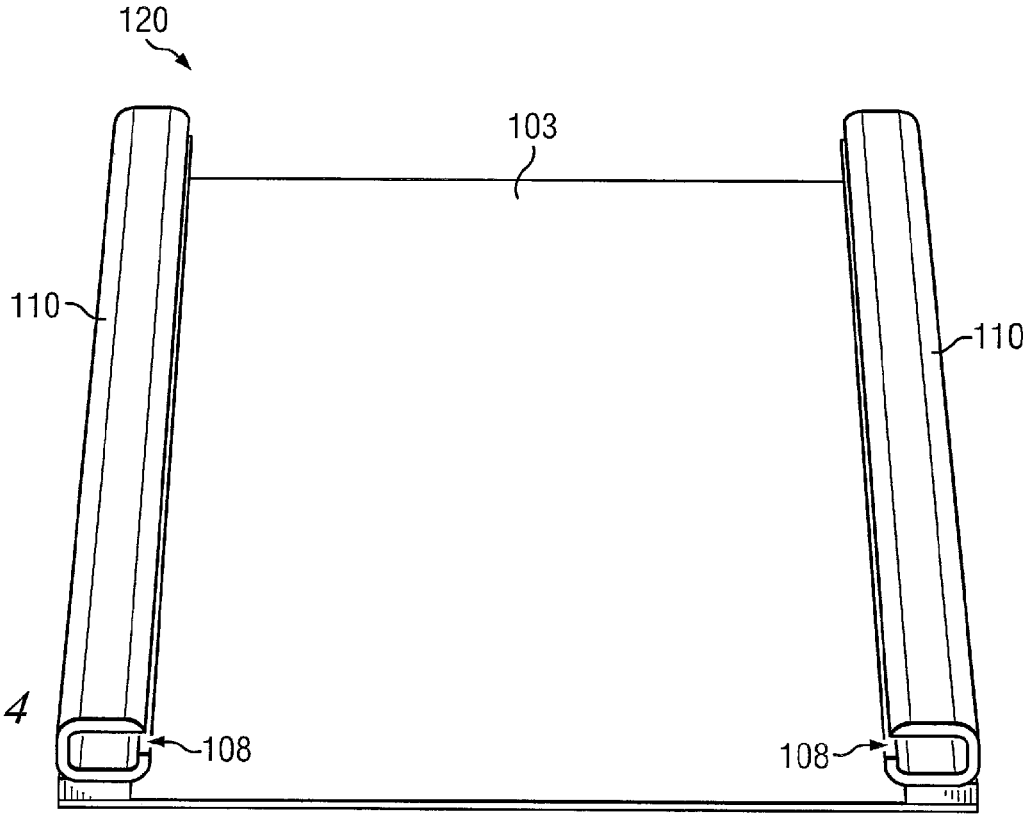
FIG. 4 depicts a perspective view of one example embodiment of a frame having channels mounted onto a back panel.

As discussed above, a multi-planar image display system may comprise a frame configured to support and/or protect an insert. FIG. 4 depicts one embodiment of frame 120 having channels 110 with openings 108 and back plate 103. Each of channels 110 is adapted to receive an edge portion of insert 130 through openings 108.

Figure 5C:
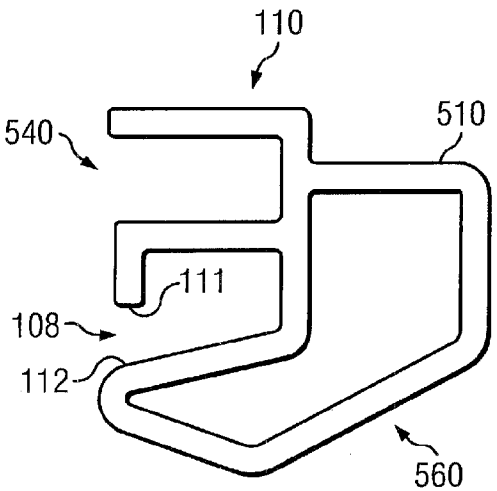
FIG. 5C depicts a diagrammatic representation of a top view of one embodiment of a holding means configured to hold an insert and a back panel.
Figure 5B:
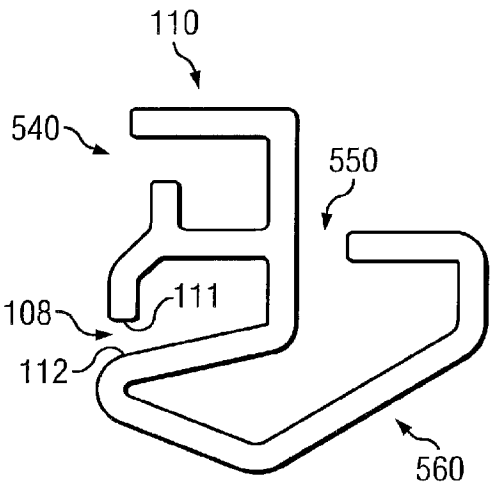
FIG. 5B depicts a diagrammatic representation of a top view of one embodiment of a holding means configured to hold an insert and a back panel.
Figure 5A:
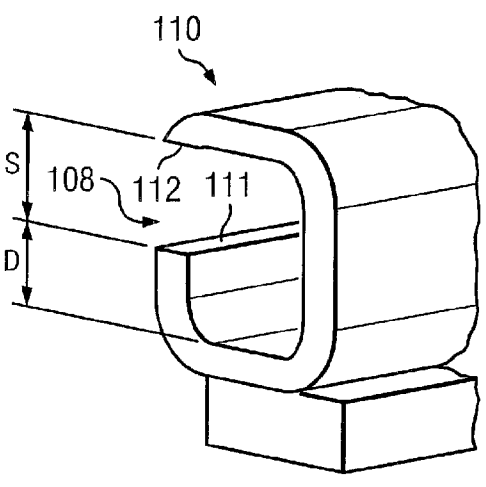
FIG. 5A depicts a close up view of a portion of a channel shown in FIG. 4.

FIGS. 5A-5C depict various example embodiments of channels 110. In some embodiments, channel 110 may be formed by extrusion of a material. In some embodiments, channel 110 may be formed as tubing with subsequent machining to form opening 108. In some embodiments, channel 110 may be formed by bending a sheet to form sides and opening 108. Opening 108 may be formed centered on a side of channel 110.

In some embodiments, each channel may have a cross-sectional profile resembling the letter "C" or "G" having an opening running along the length of the channel. In some embodiments, the opening may be adapted or otherwise configured to catch or capture a portion of the insert. More specifically, the opening may have a lip, edge, rim, or groove to catch a part of a holding means of an insert.

In one embodiment depicted in FIG. 5A, opening 108 may be formed on a side but offset from a centerline or midpoint. In this example, channel 110 has a cross-sectional profile that substantially resembles the letter "C" with opening 108 running lengthwise along a longitudinal axis of channel 110. Referring to FIGS. 2 and 5A, the size (S) of opening 108 of channel 110 may be particularly configured to accommodate a first thickness (t1) of sheets 101A-E of insert 130 and the depth (D) of opening 108 of channel 110 may be particularly configured to accommodate a second thickness (t2) of sheets 101A-E and holding means 106 of insert 130. In some embodiment, S may be configured to be between t1 and t2 such that insert 130 can only be loaded into channels 110 from the top or bottom of channels 110.

Opening 108 may be defined by first and second edges 111, 112. First and second edges 111, 112 may be shaped, textured or otherwise configured for contact with insert 130. The distance between channels 110 and edges 111 and 112 of openings 108 can be particularly configured such that when both holding means 106 are positioned in openings 108 of channels 110, channels 110 would retain insert 130 with sufficient tension to prevent insert 130 from slipping or sliding back out. In some embodiments, openings 108 of channels 110 may be configured to further accommodate a cover. In some embodiments, this cover may provide additional protection and/or visual enhancement to the insert. For example, the cover may be made of a material to reduce or eliminate glare. As another example, the cover may reduce or eliminate static charge. In some embodiments, the presence of this cover may provide additional tension to the insert, facilitating the secure coupling between the frame and the insert. The cover may be clear or tinted.

FIGS. 5B and 5C depict exemplary alternate configurations of channel 110. FIG. 5B depicts channel 110 having additional openings 540 and 550 and wall 560. FIG. 50 depicts channel 110 having additional openings 540 and walls 510, 560. These configurations may be advantageous for various displays, as discussed below.

Figure 6A:
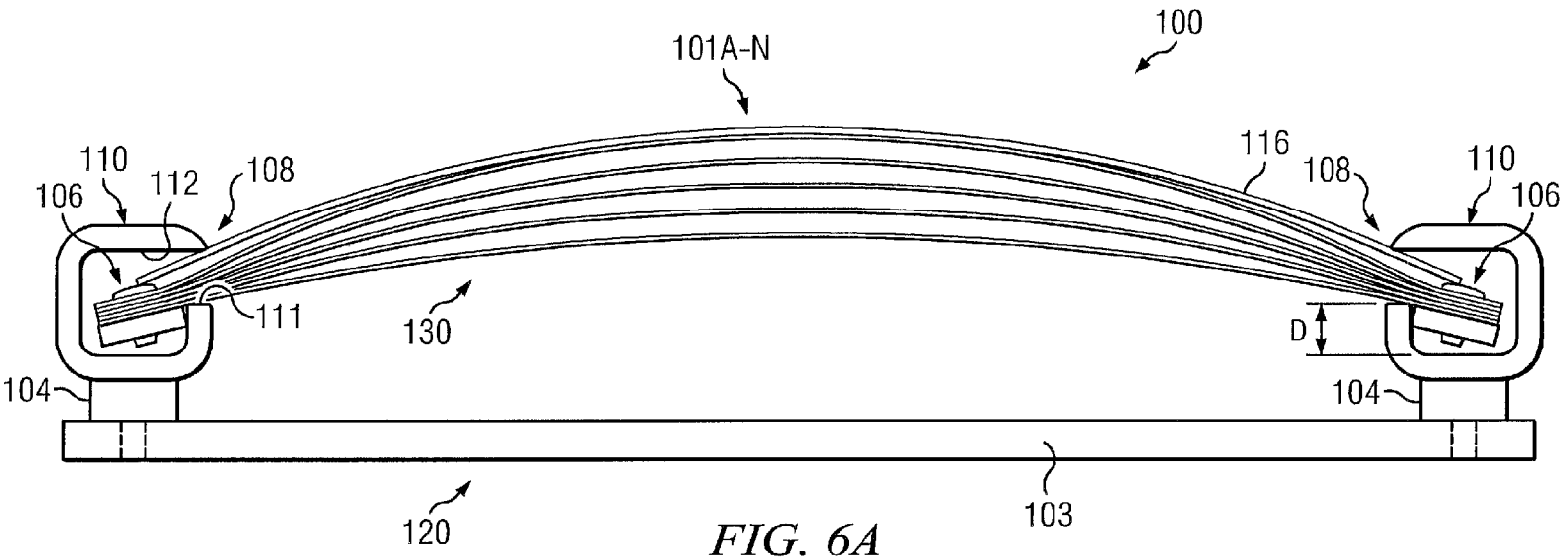
FIG. 6A depicts a diagrammatic representation of a top or bottom view of a multi-planar image display system comprising an insert and a frame holding the insert in tension.
Figure 6B:
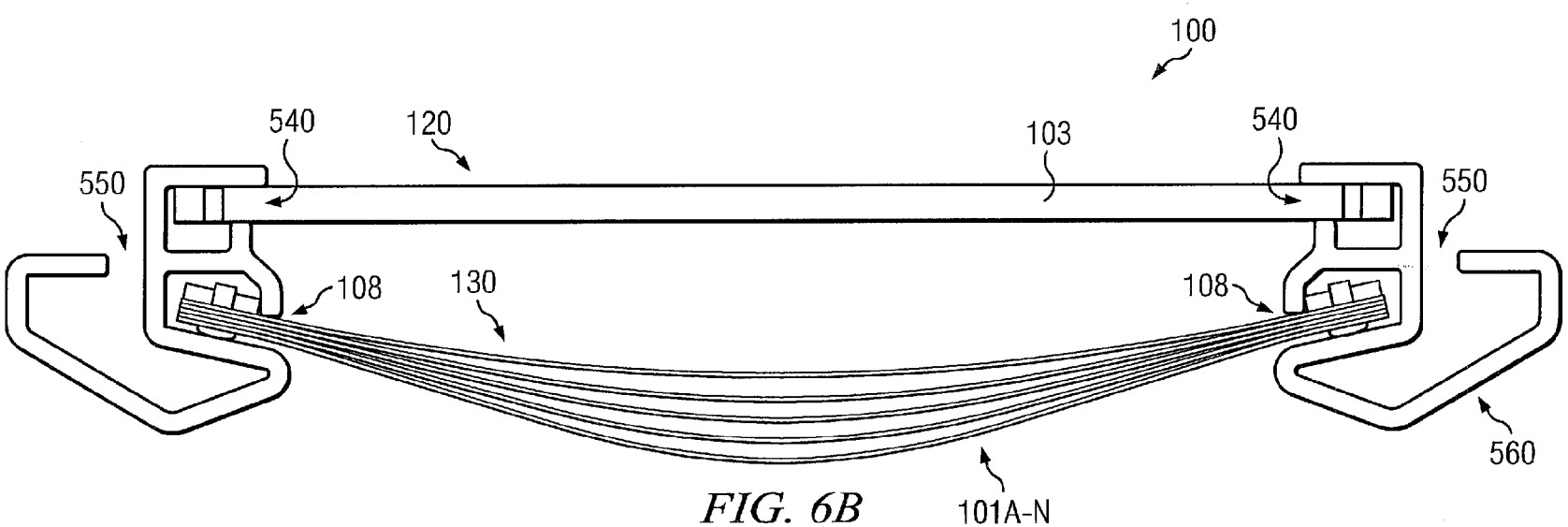
FIG. 6B depicts a diagrammatic representation of a top or bottom view of one embodiment of a display unit employing a pair of the holding means exemplified in FIG. 5B.
Figure 6C:
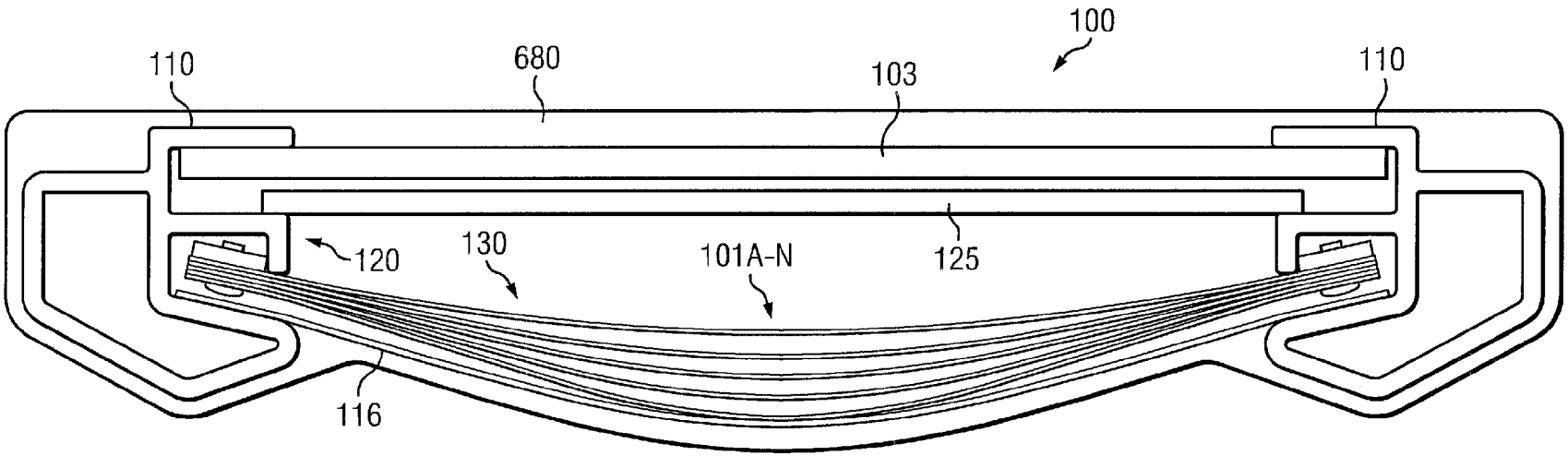
FIG. 6C depicts a diagrammatic representation of a top or bottom view of one embodiment of a display unit employing a pair of the holding means exemplified in FIG. 5C.

FIGS. 6A-6C depict top or bottom views of embodiments of multi-planar display systems 100 having various configurations of frames 120 and channels 110, such as those depicted in FIGS. 5A-5C. In some embodiments, sheets 101A-N may be retained in frame 120 via holding means 106 positioned in openings 108 of channels 110.

Figure 8:
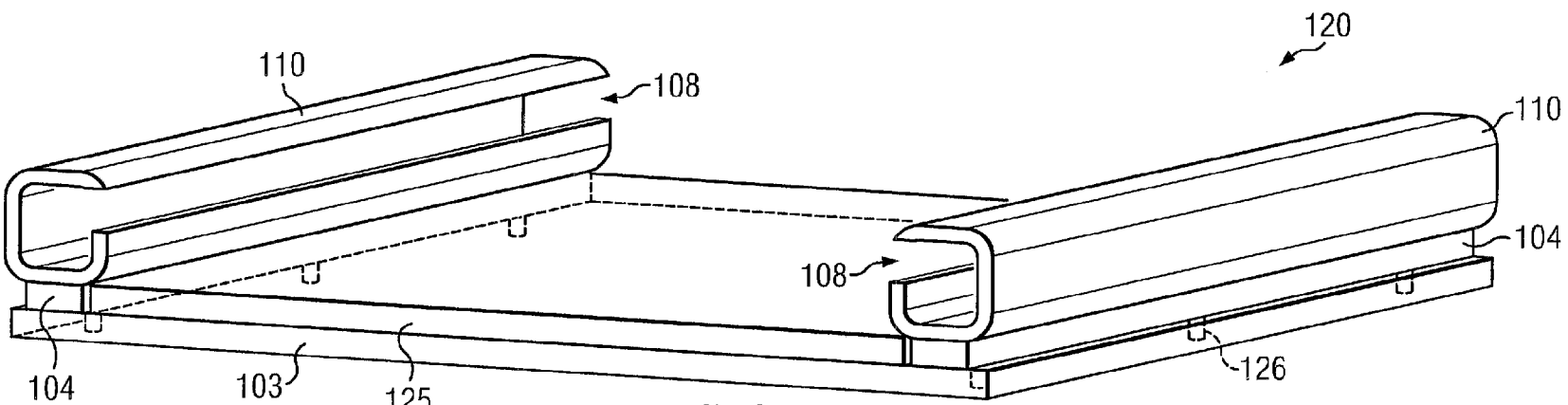
FIG. 8 depicts a diagrammatic representation of a perspective view of one example embodiment of a frame.

In some embodiments, frame 120 may comprise spacers 104. As illustrated in FIG. 8, in some embodiments, spacers 104 may be configured to accommodate board or light panel 125.

In some embodiments, protective layer 116 may also be positioned in opening 108, or may be positioned in other openings. Back plate 103 or light panel 125 may be positioned in other openings 540.

In some embodiments, casing or housing 680 may be useful for surrounding display system 100 to prevent exposure to the elements, protect against theft or other unwanted removal, and may contain text, graphics or some other features which may or may not related to the image.

Additionally, in some embodiments, a frame can also be built to hold one or more larger pictures either on top or bottom with surrounding smaller shots. These pictures may include 2D as well as 3D images.

It is contemplated that, in addition to top-loading embodiments, the frame can be assembled using side-loading, bottom loading, or a combination thereof. Moreover, the frame can be integrated with holding means for displaying text and/or 2D imagery and audio and other enhancement devices in addition to the multi-planar image.

Figure 7:
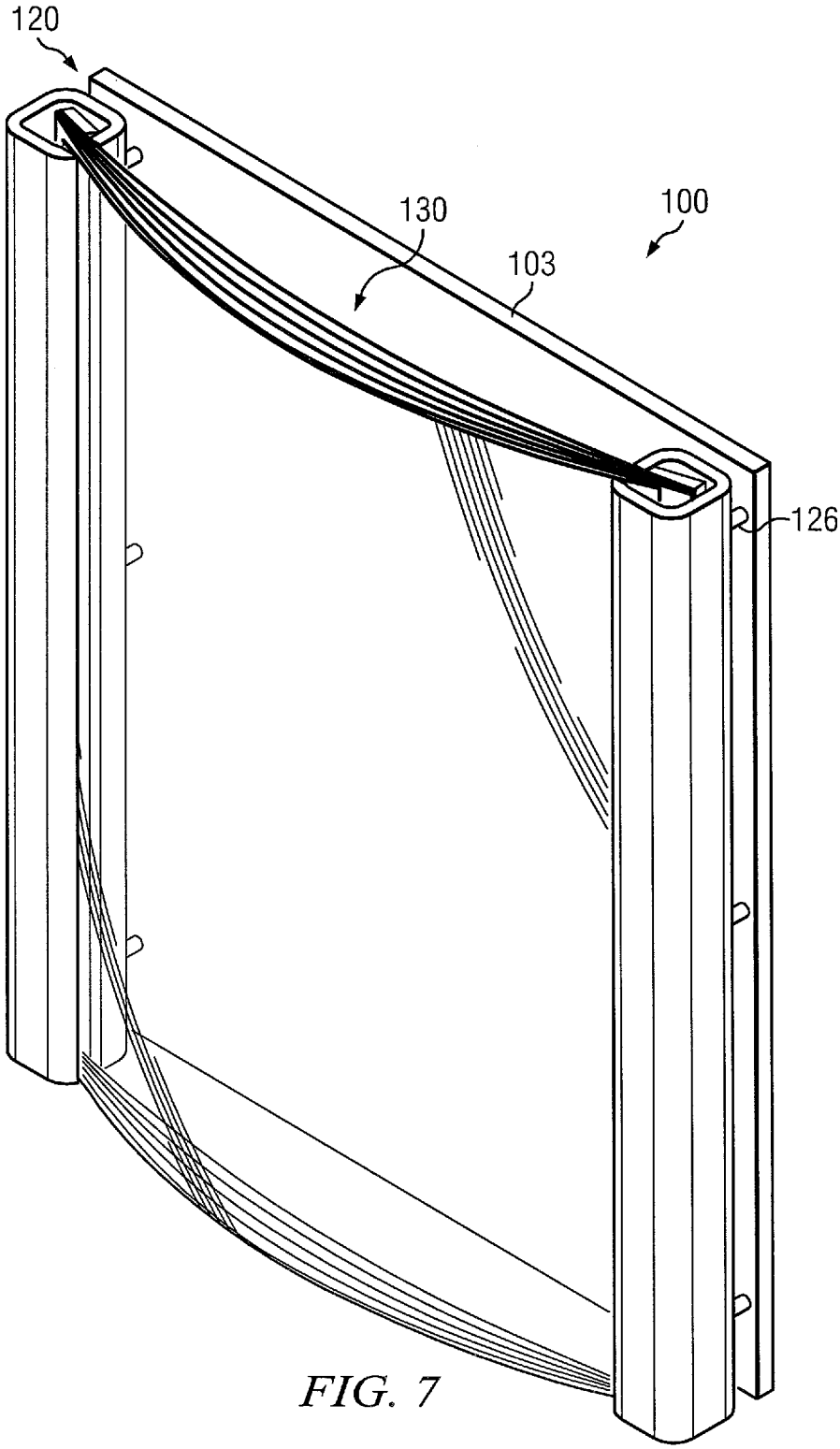
FIG. 7 depicts a diagrammatic representation of a perspective view of one embodiment of a multi-planar image display system.

FIG. 7 depicts a diagrammatic representation of a perspective view of one embodiment of multi-planar display system 100 comprising frame 120 and insert 130 being held in a pair of channels 110 of frame 120. In the example of FIG. 7, channels 110 are positioned on opposite edges of back plate 103. Insert 130 may include sheets 101A-N having varying curve profiles and be positioned with edges in openings 108 of channels 110 such that the various curve profiles are maintained to display an image in varying selected depths. As discussed above, channels 110 may be configured to accommodate sheets 101A-N and holding means 106. As exemplified in FIGS. 6A and 6C, in some embodiments, openings 108 in channels 110 may accommodate insert 130 as well as cover 116, which may be selected to protect against damage, may provide anti-glare properties, etc. The distance between the pair of channels 110 of frame 120 may be predetermined to fit a certain size of insert 130. Alternatively, the size of insert 130 may be configured to fit a certain size of frame 120 having a predetermined distance between the pair of channels 110.

In this way, channels 110 of frame 120 may securely hold insert 130 in tension to prevent movement between frame 120 and insert 130.

In some embodiments, frame 120 of multi-planar image display system 100 may further comprise additional components. FIG. 8 depicts a diagrammatic representation of a perspective view of one example embodiment of frame 120 including channels 110 coupled with back panel 103 via stubs 126, and further including light panel 125. Although spacers 104 are shown being positioned between channels 110 and back panel 103 in FIG. 8, in some embodiments, channels 110 may be directly affixed onto back panel 103 using, for example, an adhesive such as glue. In some embodiments, channels 110 and back panel 103 may be monolithically formed as a single piece.

Figure 9:
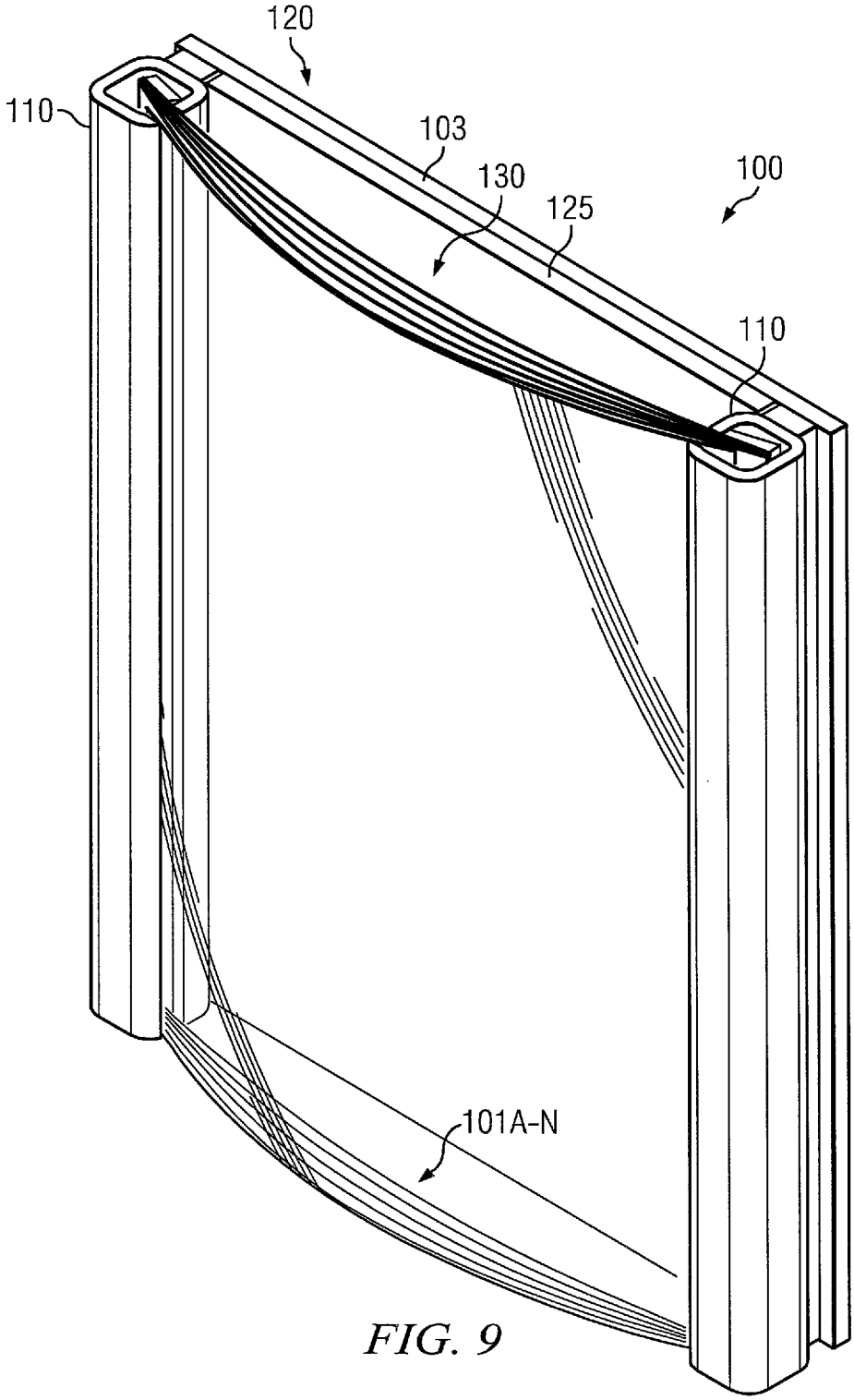
FIG. 9 depicts a diagrammatic representation of a perspective view of one embodiment of a multi-planar image display system.

FIG. 9 depicts a perspective view of one embodiment of multi-layer image display system 100 having frame 120, insert 130, and board 125. As discussed above, insert 130 may comprise properly aligned layers or sheets 101A-E affixed to one another via holding means 106. Insert 130 may be positioned in channels 110 of frame 120. Board 125 may be positioned in frame 170 between insert 130 and back plate 103. In some embodiments, board 125 may integrate or otherwise include a light source for illuminating insert 130. Embodiments disclosed herein may utilize the geometry of channel 110, including the shape, positioning, or other characteristic of opening 108, as well as one or more characteristics of insert 130, including the number of sheets 101 or the thickness of sheets 101A-N, and the presence of any additional layers 116 (as exemplified in FIGS. 6A and 6C), to determine a desired tension to hold sheets 101A-N in place. In some embodiments, frame 120 may further utilize the dimensions of strips 113 or other features of holding means 106 to provide sufficient friction or tensile forces to hold light panel 125 in position.

Figure 10A:
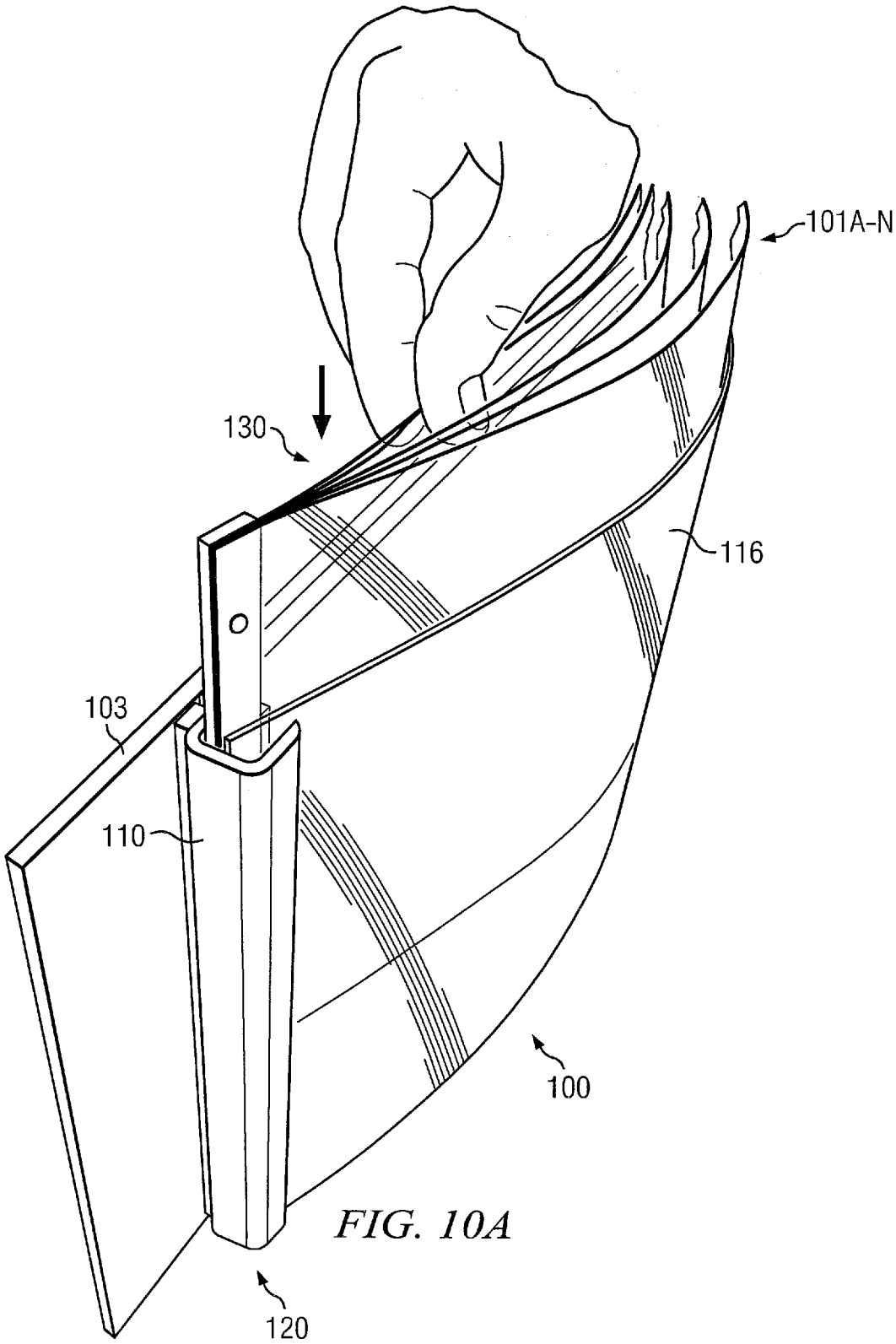
FIG. 10A depicts a perspective view of one example embodiment of an insert being inserted into one example embodiment of a frame.

In some embodiments, an insert may be loaded into a frame in various ways, including from the top, bottom, or side of the frame. FIG. 10A depicts a perspective view of a pre-bound, end-riveted, multi-layer image insert being inserted into a frame, according to a top-loading example embodiment. An acrylic face sheet or cover can be placed into the frame in front of the insert as protection against scratches. The cover may be inserted into the frame before, after, or simultaneously with the insert. The cover may be slightly tinted. A tinted cover may help reducing glare if necessary.

Figure 10B:
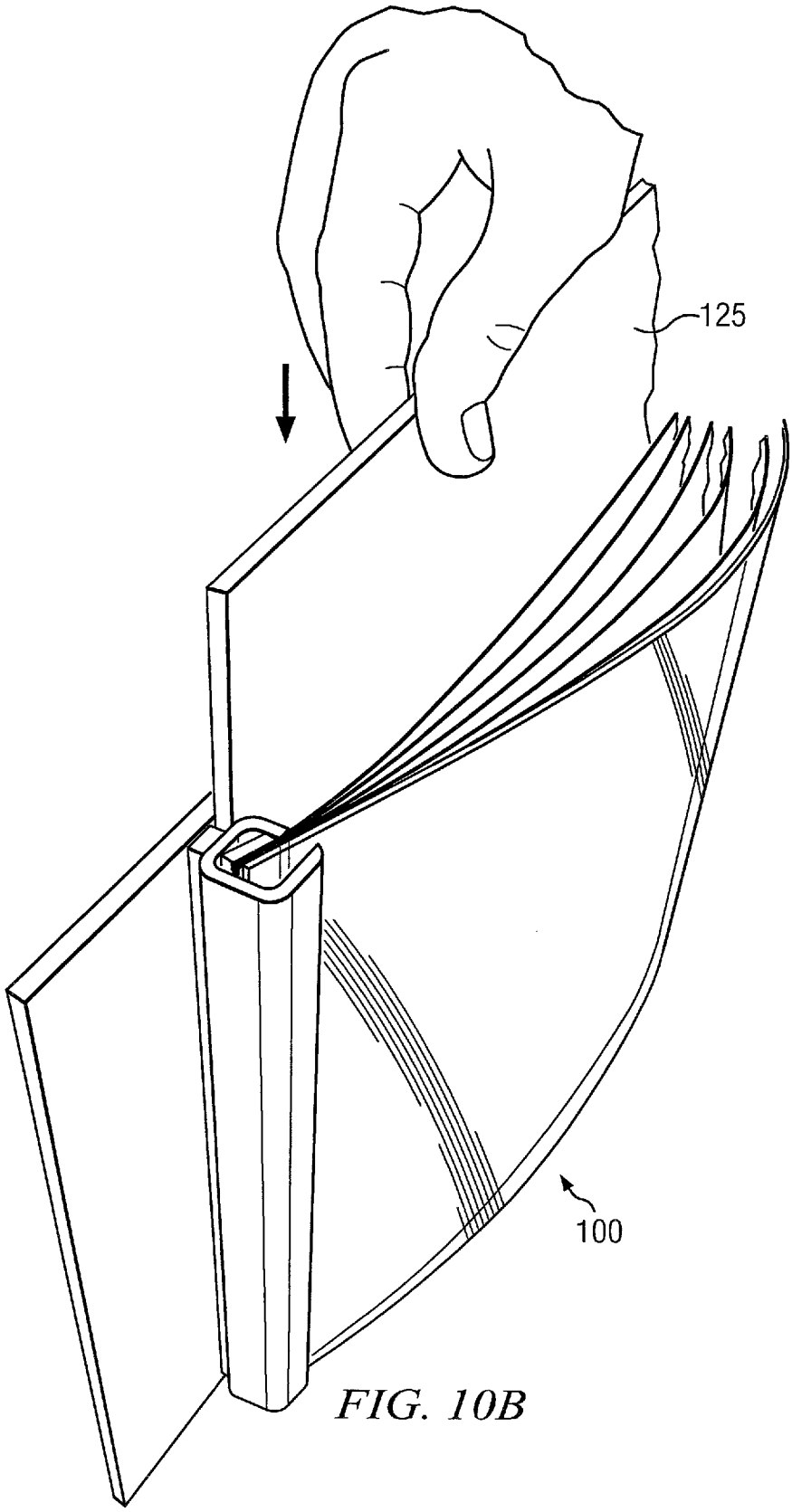
FIG. 10B depicts a perspective view of a board being placed into the frame behind the insert of FIG. 10A.

FIG. 10B depicts a perspective view of a board being placed into the frame behind the insert of FIG. 10A. In some embodiments, the board has embedded LED light to provide illumination for the insert. Sheets 101A-N of insert 130 may be securely held at opposite ends by channels 110 and are curved with equal spacing in between sheets 101A-N. Because insert 130 can be held in frame 120 by tension, channels 110 do not need end caps or other closure members to prevent insert 130 from accidentally withdrawing from frame 120. However, if so desired, channels 110 can be adapted to accommodate end caps or other closure members.

In some embodiments, a fixed size frame 120 may not be necessary. Instead, frame 120 may be implemented utilizing a pair of holding means 110 and a back panel or board 103. More specifically, openings 108 of the pair of holding means 110 may be configured to retain both insert 130 and back panel or board 103. The size of back panel or board 103 may be configured to cause an embodiment of insert 130 be held in tension via the pair of holding means 110 in a similar manner as described above. In some embodiments, back panel or board 103 may include a light source. One example of a light source may be a LED or a set of LEDs. In some embodiments, back panel or board 103 may be a laminated foam board.

Embodiments disclosed herein can provide many advantages over the more difficult and inexact nature of inserting and or extracting individual sheets for multi-planar images. For example, an embodiment of an insert disclosed herein can be readily used in conjunction with existing or commercially available display systems in various places such as backlit ad displays. Embodiments of a display unit disclosed herein can be used for various purposes, including lighted or ambient lighted imagery for, but are not limited to, advertising displays, framed iconic pictures, in-home framed pictures/artwork of children, spouses, pets, loved ones, and so on.

As a specific example, an existing backlit ad display system commonly seen in a shopping mall, store, or theatre can be adapted to accept an insert unit of encased plastic sheets to display layered images in front of the display. Subsequently, the insert can be easily replaced with another insert of a different multi-planar imagery. This ease of insertion and extraction is particularly suitable for point of purchase advertising. More specifically, the light-box frame can remain installed while the one-piece image insert can be easily exchanged with new images as the advertiser(s) dictate.

Figure 11A:
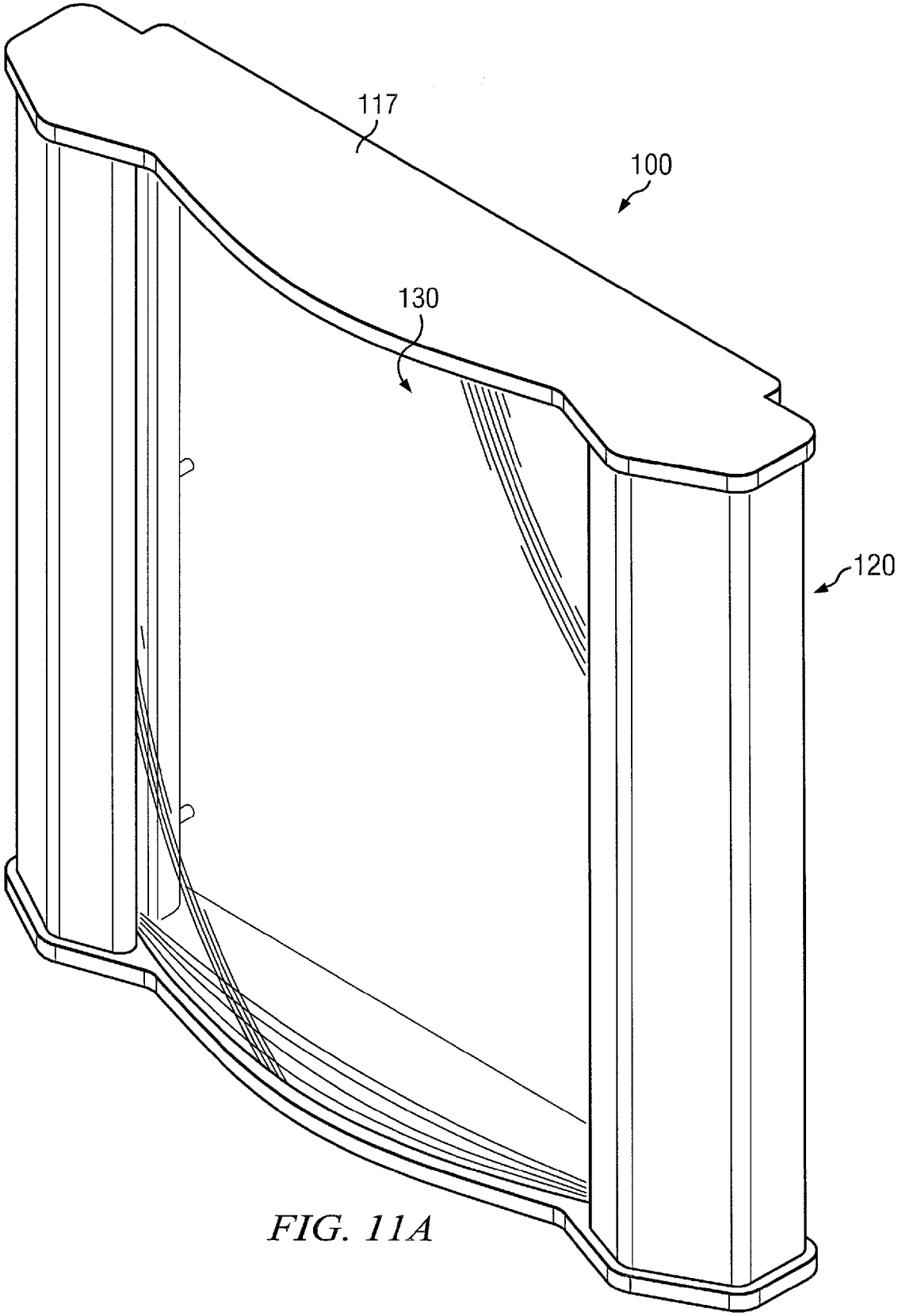
FIG. 11A depicts a diagrammatic representation of a perspective view of one embodiment of a multi-planar image display system.

FIG. 11A depicts a perspective view of one embodiment of multi-planar display unit 100 in which frame 120 may further include cap 117, which may be useful for preventing moisture, insects, or debris from contacting insert 130 or may be configured to prevent removal or destruction of insert 130 by unauthorized persons.

Figure 11B:
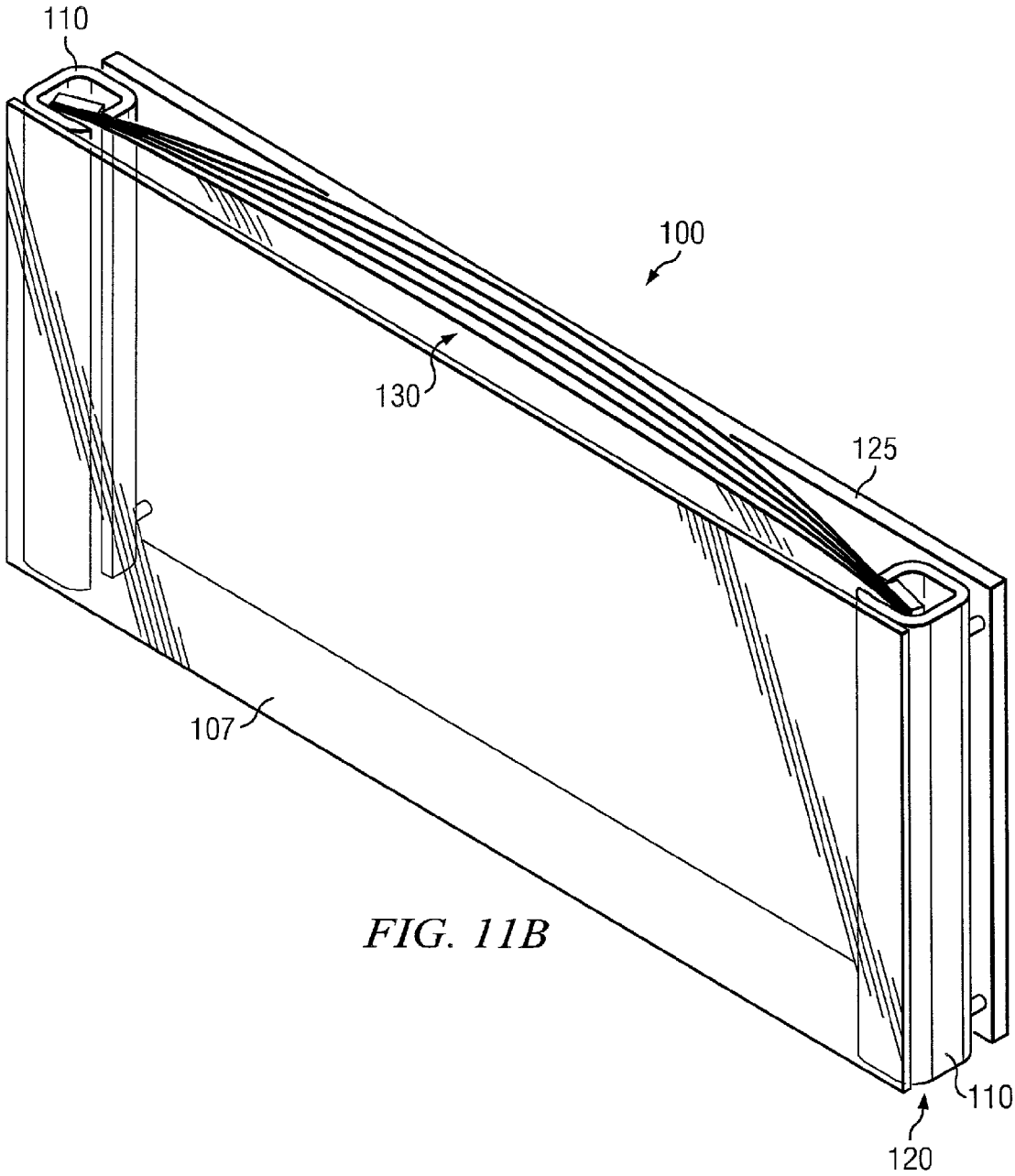
FIG. 11B depicts a diagrammatic representation of a perspective view of another one embodiment of a multi-planar image display system.

FIG. 11B depicts a perspective view of another example embodiment of multi-planar image display unit 100 comprising concave 5-layer image insert 130 positioned in frame 120 between light board 125 and clear panel 107. In this example, insert 130 has riveted end pieces and the image is 36" wide and 4" high. Panel 107 may be formed as a sheet of plexiglass® with a desired rigidity for specialized applications.

Figure 12:
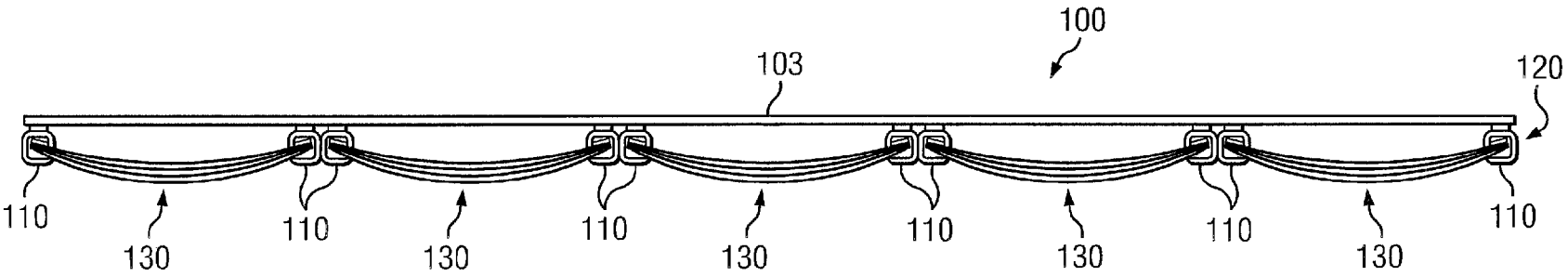
FIG. 12 depicts a diagrammatic representation of a top or bottom view of one embodiment of a frame configured to hold multiple inserts.

As those skilled in the art can appreciate, a multi-insert frame can be used for image collections such as "the five best centerfielders of all time," "five most desirable classic cars," etc. Various frame and/or frame assemblies can be implemented to hold any number of image units. This type of multi-insert frames can be built in different sizes—width, height, and depth. FIG. 12 depicts a top or bottom view of one embodiment of multi-planar display system 100 having multiple sets of inserts 130 held in channels 110 of frame 120, which may be supported by back panel 103.

Figure 13:
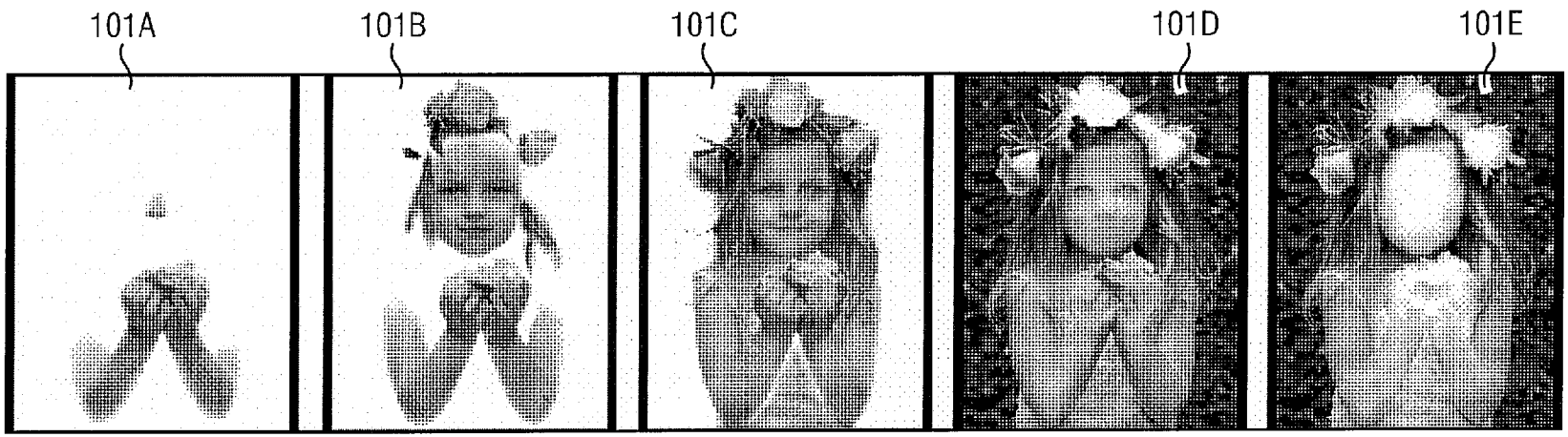
FIG. 13 depicts an exemplary set of sheets, each having a portion of an image.

The different layers making up the total image can be printed on a set of sheets. As an example, FIG. 13 depicts a set of five sheets 101A-E, each having a portion of an image printed thereon. In this example, pixels of varying density can be found on two or more sheets at the same spot, location, or coordinates. As discussed above, insert 130 can hold sheets 101A-E with varying curve profile in perfect alignment and equal spacing there-between, allowing these pixels to create a "depth" perspective.

Figure 14B:
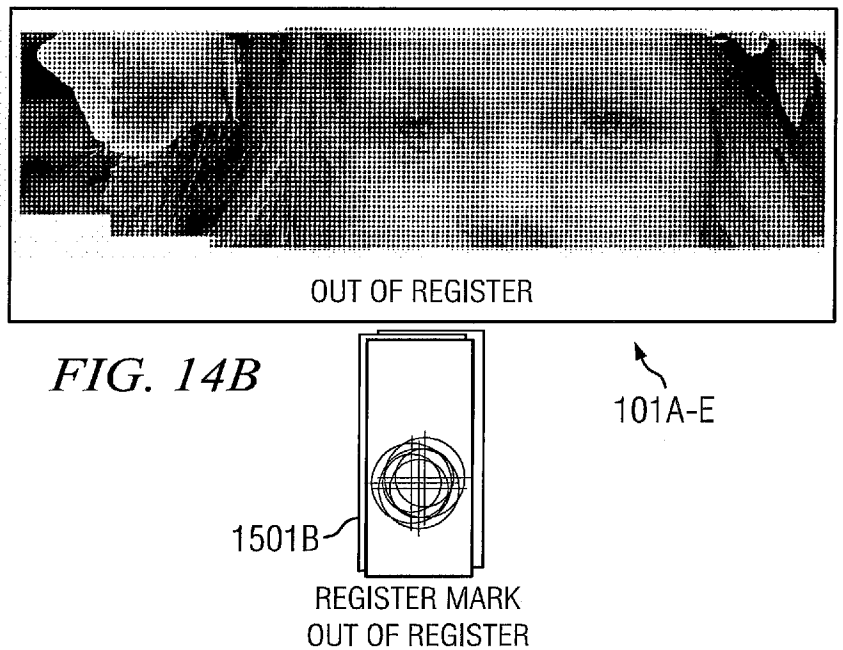
FIG. 14B depicts an image produced by the exemplary set of sheets of FIG. 13 being out of register.
Figure 14A:
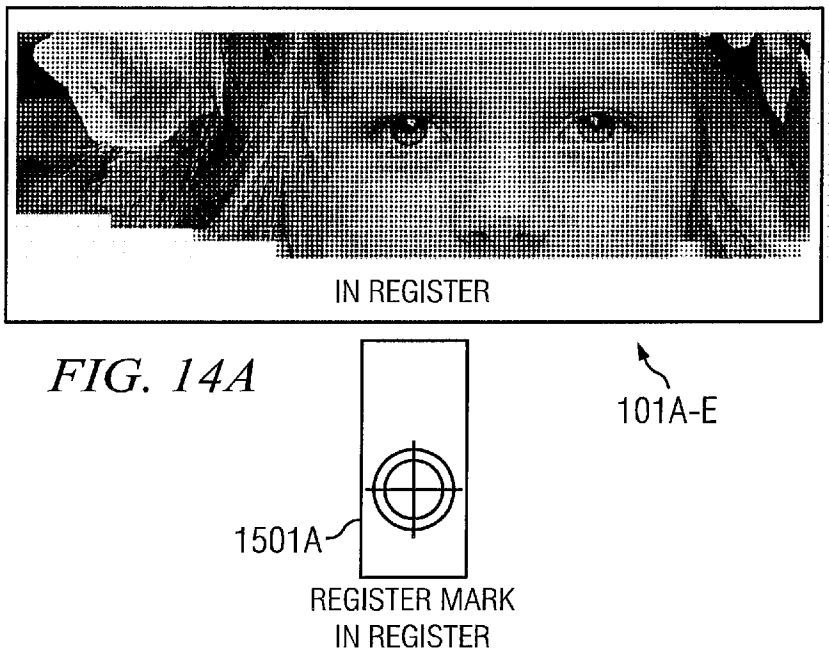
FIG. 14A depicts an image produced by the exemplary set of sheets of FIG. 13 being in register.

FIG. 14A depicts a close up view of an example set of sheets 101A-E properly aligned, as evidenced by register mark 1501A, to produce a 3D imagery of a person. FIG. 14B depicts a close up view of the same example set of sheets 101A-E being out of alignment, as evidenced by register mark 1501B.

Although the invention has been described with respect to specific embodiments thereof, these embodiments are merely illustrative, and not restrictive of the invention. The description herein of illustrated embodiments of the invention, including the description in the Abstract and Summary, is not intended to be exhaustive or to limit the invention to the precise forms disclosed herein (and in particular, the inclusion of any particular embodiment, feature or function within the Abstract or Summary is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function, including any such embodiment feature or function described in the Abstract or Summary. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

Although the steps, operations, or the like may be presented in a specific order, this order may be changed in different embodiments. In some embodiments, to the extent multiple steps are shown as sequential in this specification, some combination of such steps in alternative embodiments may be performed at the same time or over a period of time.

Some embodiments described herein can be implemented in the form of control logic in software or hardware or a combination of both. The control logic may be stored in an information storage medium, such as a computer-readable medium, as a plurality of instructions adapted to direct an information processing device to perform a set of steps disclosed in the various embodiments. Based on the disclosure and teachings provided herein, a person of ordinary skill in the art will appreciate other ways and/or methods to implement the invention.

It is also within the spirit and scope of the invention to implement in software programming or code any of the steps, operations, methods, routines or portions thereof described herein, where such software programming or code can be stored in a computer-readable medium and can be operated on by a processor to permit a computer to perform any of the steps, operations, methods, routines or portions thereof described herein. The invention may be implemented by using software programming or code in one or more general purpose digital computers, by using application specific integrated circuits, programmable logic devices, field programmable gate arrays, optical, chemical, biological, quantum or nanoengineered systems, components and mechanisms may be used. In general, the functions of the invention can be achieved by any means as is known in the art. For example, distributed, or networked systems, components and circuits can be used. In another example, communication or transfer (or otherwise moving from one place to another) of data may be wired, wireless, or by any other means.

A "computer-readable medium" may be any medium that can contain, store, communicate, propagate, or transport the program for use by or in connection with the instruction execution system, apparatus, system or device. The computer readable medium can be, by way of example only but not by limitation, an electronic, magnetic, optical, electromagnetic, infrared, or semiconductor system, apparatus, system, device, propagation medium, or computer memory. Such computer-readable medium shall generally be machine readable and include software programming or code that can be human readable (e.g., source code) or machine readable (e.g., object code). Examples of non-transitory computer-readable media can include random access memories, read-only memories, hard drives, data cartridges, magnetic tapes, floppy diskettes, flash memory drives, optical data storage devices, compact-disc read-only memories, and other appropriate computer memories and data storage devices. In an illustrative embodiment, some or all of the software components may reside on a single computer or distributed among computers. As one skilled in the art can appreciate, a computer program product implementing an embodiment disclosed herein may comprise one or more non-transitory computer readable media storing computer instructions translatable by one or more processors in a computing environment.

As used herein, the terms "comprises," "comprising," "includes," "including," "has," "having," or any other variation thereof, are intended to cover a non-exclusive inclusion.

For example, a process, product, article, or apparatus that comprises a list of elements is not necessarily limited only those elements but may include other elements not expressly listed or inherent to such process, process, article, or apparatus.

Furthermore, the term "or" as used herein is generally intended to mean "and/or" unless otherwise indicated. For example, a condition A or B is satisfied by any one of the following: A is true (or present) and B is false (or not present), A is false (or not present) and B is true (or present), and both A and B are true (or present). As used herein, including the claims that follow, a term preceded by "a" or "an" (and "the" when antecedent basis is "a" or "an") includes both singular and plural of such term, unless clearly indicated within the claim otherwise (i.e., that the reference "a" or "an" clearly indicates only the singular or only the plural). Also, as used in the description herein and throughout the claims that follow, the meaning of "in" includes "in" and "on" unless the context clearly dictates otherwise. The scope of the present disclosure should be determined by the following claims and their legal equivalents.

What is claimed is:

1. A multi-planar image display system comprising:

an insert comprising:

a plurality of sheets having different widths, the plurality of sheets being non-opaque, wherein each sheet of the plurality of sheets comprises a portion of an image; and a pair of holding means for holding edges of the plurality of sheets in alignment, causing the plurality of sheets to form a plurality of predetermined curve profiles, the curve profiles being configured to display the image in varying depths, wherein each of the pair of holding means comprises:

at least one member having a plurality of holes; and a plurality of pins or rivets configured to be received in the plurality of holes.

2. The multi-planar image display system of claim 1, wherein the pair of holding means comprises a first side panel configured to maintain a first set of the edges of the plurality of sheets in alignment and a second side panel configured to maintain a second set of the edges of the plurality of sheets in alignment.

3. The multi-planar image display system of claim 1, wherein each portion of the image comprises a plurality of pixels, wherein holding the plurality of sheets in alignment causes a first pixel on a first sheet to align with a second pixel on a second sheet.

4. The multi-planar image display system of claim 1, further comprising a frame, wherein the pair of holding means are configured for positioning in the frame, wherein the frame comprises a pair of channels having a channel length, the pair of channels being separated by a selected distance, each channel comprising an opening having a length substantially equal to the channel length, wherein the selected distance is configured to cause the insert to be held in tension in the pair of channels of the frame.

5. The multi-planar image display system of claim 4, wherein the frame further comprises a back plate.

6. The multi-planar image display system of claim 4, further comprising a cover configured to be removably coupled to the frame via the pair of channels.

7. The multi-planar image display system of claim 4, wherein the frame further comprises a board configured to be removably coupled to the frame between the pair of channels.

8. The multi-planar image display system of claim 1, further comprising a light source.

9. The multi-planar image display system of claim 1, wherein each of the pair of holding means comprises two members, each member being configured for binding the plurality of sheets at an edge thereof.

10. A method for forming a multi-planar image display system, comprising:

determining a plurality of layers for displaying an image;

printing a portion of the image on each of a plurality of sheets, the plurality of sheets having different widths;

aligning edges of the plurality of sheets to form different predetermined curve profiles, the curve profiles being configured to display the image in varying depths; affixing the plurality of sheets with a pair of holding means in alignment at the edges; and positioning the pair of holding means in a pair of channels in a frame having a channel length, the pair of channels being separated by a selected distance, each of the pair of channels comprising an opening having a length substantially equal to the channel length, wherein the selected distance is configured to cause the insert to be held in tension in the pair of channels in the frame.

11. The method of claim 10, further comprising removably coupling a board to the frame between the pair of channels.

12. The method of claim 10, further comprising removably coupling a back plate to the frame.

13. The method of claim 10, further comprising removably coupling a cover to the frame via the pair of channels.

14. The method of claim 10, further comprising removably coupling a light source to the frame.

15. A multi-planar image display system comprising:

an insert comprising:

a plurality of sheets having different widths, the plurality of sheets being non-opaque, wherein each sheet of the plurality of sheets comprises a portion of an image;

a pair of holding means for holding edges of the plurality of sheets in alignment, causing the plurality of sheets to form a plurality of predetermined curve profiles, the curve profiles being configured to display the image in varying depths; and a frame, wherein the pair of holding means are configured for positioning in the frame, wherein the frame comprises a pair of channels having a channel length, the pair of channels being separated by a selected distance, each of the pair of channels comprising an opening having a length substantially equal to the channel length, wherein the selected distance is configured to cause the insert to be held in tension in the pair of channels in the frame.

16. The multi-planar image display system of claim 15, wherein each of the pair of holding means comprises at least one member configured for binding the plurality of sheets at an edge thereof.

17. The multi-planar image display system of claim 15, further comprising a cover configured to be removably coupled to the frame via the pair of channels.

18. The multi-planar image display system of claim 15, further comprising a light source.

* * * * *